United States Patent [19]

Jensen

[11] Patent Number: 4,802,258

[45] Date of Patent: Feb. 7, 1989

[54] COMBINATION DUSTPAN AND GUIDE MEANS FOR FILLING TRASH CONTAINERS AND THE LIKE

[76] Inventor: Otto S. Jensen, 5650 Panorama Dr., Whittier, Calif. 90601

[21] Appl. No.: 27,257

[22] Filed: Mar. 18, 1987

[51] Int. Cl.[4] ..... A47L 13/52

[52] U.S. Cl. ..... 15/257.1; 15/257.4; 220/85 R; 141/108

[58] Field of Search ..... 15/257.1, 257.2, 257.3, 15/257.4, 257.8, 257.5, 257.6, 257.7, 257.9; 220/90, 85 F, 1 T, 85 R; 141/108; 206/496

[56] References Cited

U.S. PATENT DOCUMENTS

| | | | |
|---|---|---|---|
| 2,812,784 | 11/1957 | Palmer | 15/257.3 X |
| 3,156,941 | 11/1964 | Tomainolo | 15/257.1 |
| 3,833,249 | 9/1974 | McKinney | 15/257.1 X |
| 3,986,744 | 10/1976 | Krogstad | 15/257.6 X |
| 4,312,531 | 1/1982 | Cross | 15/257.1 X |
| 4,550,440 | 10/1985 | Rico | 220/1 T X |

*Primary Examiner*—Philip R. Coe
*Assistant Examiner*—K. L. O'Leary
*Attorney, Agent, or Firm*—Francis X. LoJacono

[57] ABSTRACT

The combination dustpan and guide for filling trash containers and the like according to the invention provides a dustpan having a scoop portion and a rearwardly disposed handle arranged to be removably attached to a conventional trash container, whereby the container, with the attached dustpan, can be laid in a horizontal position to receive debris therein by sweeping it directly into the container by the scoop portion of the dushpan which further includes stabilizing flanges disposed on each side and extending rearwardly thereof, so as to cooperate with the handle in defining a structure for removably attaching the dustpan to the opening of the trash container.

5 Claims, 2 Drawing Sheets

COMBINATION DUSTPAN AND GUIDE MEANS FOR FILLING TRASH CONTAINERS AND THE LIKE

BACKGROUND OF THE INVENTION

1. Field of the Invention

This invention relates to a trash and debris collector, and more particularly to a dustpan arranged to be removably attached to a trash can or like container so as to be employed as a guide by which the debris can be readily sweeped into the container when the container is laid on its side.

2. Description of the Prior Art

It is well known that there have been difficulties encountered in filling trash containers or cans with debris such as trash, lawn clippings, leaves, etc.

Generally, a dust pan is used to pick up debris. However, when there are large amounts of leaves and lawn clippings it becomes a back-breaking and time-consuming job. One must sweep the debris onto the dustpan and then dispose the material in a refuse container. Oftentimes, much of the debris is dropped from the dustpan. The same occurs if a shovel is used in place of a dust pan.

Various devices have been used to assist in overcoming this problem. however, these devices have features that restrict their use; and they are often complicated to operate due to the many parts that are required for attachment to a container. Furthermore, the majority of known devices presently in use are designed to cooperate with plastic trash bags.

As an example of such devices, there is disclosed in U.S. Pat. No. 4,193,157 issued to Helen F. Large a bag spreader having a ramp. The bag spreader is formed as a relatively rigid plastic hoop that is designed to be inserted into the open mouth of a flexible plastic trash bag. The hoop includes integral external spikes adapted to be driven into the ground through the bag. A specially designed trash bag must be used having a pair of holes to receive the spikes of the hoop, thus restricting the use of this device.

U.S. Pat. No. 4,470,627 issued to George and Mamie Carroll discloses a portable leaf and trash collector apparatus which provides a combined means and method for holding a bag in an open position for inserting leaves, lawn clippings and the like. The apparatus comprises a first member with a chute portion on one end, a scoop on the other end, and a groove between the chute and scoop. The chute portion is inserted into the top opening of a plastic bag, and the bag is surrounded by a ring with a handle thereon, the bag being retained between the ring and first member by snapping the ring into the groove. Again, this apparatus is only compatible with plastic trash bags.

A filling aid for plastic trash bags and the like is disclosed in U.S. Pat. No. 4,312,531 issued to Richard H. Cross. The aid includes an elongated tubular split sleeve having open inner and outer ends. The outer end of the sleeve includes an outwardly curled flange engageable over a can rim for the clamping of a bag thereto. An outwardly flaring scoop extends longitudinally from the flanged end of the sleeve, tapering from engagement with the periphery of the sleeve.

Both U.S. Pat. Nos. 4,357,728 and 4,442,567 issued to John P. Pravettove disclose a combination dustpan and refuse container which is made up of a framework which distends and substantially encloses a conventional disposable trash bag.

In U.S. Pat. No. 4,550,440 issued to Ezequiel Rico there is disclosed an article receptacle which includes a flexible bag frictionally retained between two frame members. The frames nest together to permit the bag to be inserted and removed without deforming the frames, and to permit the frictional engagement of the frames to strengthen in response to the bag load. A scoop attachment supports the frames in an upright position at ground level and includes a ramp to permit debris to be swept directly into the mouth of the bag.

OBJECTS AND SUMMARY OF THE INVENTION

The present invention comprises a dustpan device so designed as to be further employed as a guide for filling trash containers and the like, the device being formed with a main body member defining a scoop having a substantially flat front surface to receive various types of debris, including lawn clippings and leaves. The rearward end of the main body is formed with a central extension defining a handle, when the device is used as a dustpan, and further defining an attaching member.

Depending flange members are integrally formed as part of the main body and are employed as stabilizers. These oppositely disposed flange members extend beyond the scoop portion and provide attaching legs in cooperation with the handle when the dustpan is secured to the rim of the open end of the trash can or container, be it metal or plastic in structure.

The present invention, therefore, has for an important object a provision wherein a hand-holdable dustpan can be readily employed as a guide or aid in filling a trash container when the dustpan is attached to the rim of the container.

It is another object of the invention to provide a dustpan of this character wherein the handle is incorporated partly as a means for securing the dustpan to a trash container, there being a pair of rearwardly extended leg members which rest under the rim of the opening of the container as it rests on its side.

It is still another object of the present invention to provide a device of this type wherein the main body is formed with depending, stabilizing flange members throughout the full length thereof, and includes the rearwardly extended leg members. Thus, once the dustpan is attached to the mouth of a refuse container, the container can be laid horizontally and prevented from rolling by means of a pair of stabilizing flanges.

A further object of the present invention is to provide a dustpan of this character that is simple to attach and remove from various sizes of containers, and wherein a plastic trash bag may also be used therewith as a liner for the container.

It is a further object of the invention to provide a device of this character that is simple and rugged in construction.

Still another object of the invention is to provide a device of this character that is relatively inexpensive to manufacture.

Novel features and advantages of the present invention in addition to those mentioned above will become apparent to those skilled in the art from a reading of the following detailed description in conjunction with the accompanying drawings, and are pointed out with particularlity in the claims annexed to and forming a part of this disclosure.

DETAILED DESCRIPTION OF THE PREFERRED EMBODIMENT

Figure 1:
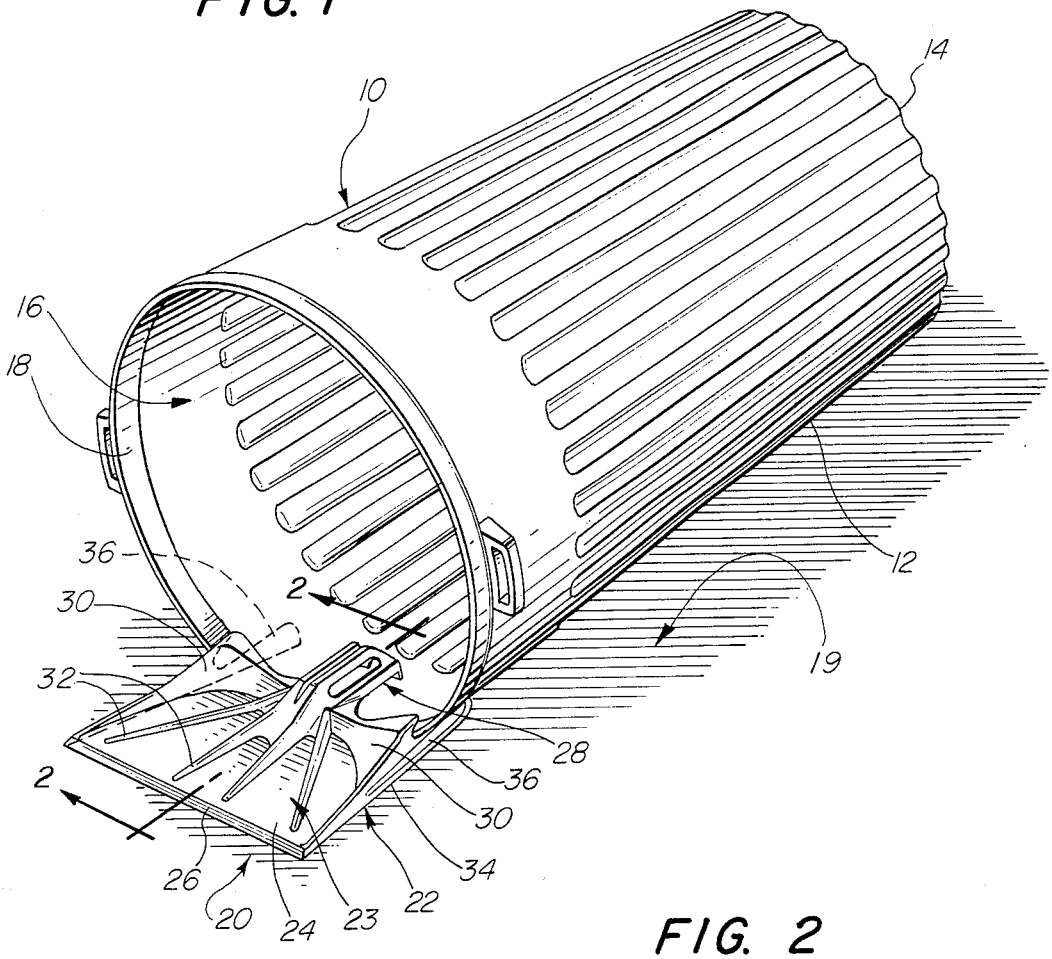
FIG. 1 is a pictorial view of the present invention shown attached to a conventional refuse container, whereby the dustpan stabilizes the container in a horizontal position to receive debris swept therein over the dustpan.

Referring more particularly to FIG. 1, there is shown a trash or refuse container having a conventional design, generally indicated at 10. The container 10 is normally formed from a heavy-duty plastic material and has an annular wall 12, a closed bottom end 14, and a top open end 16 defined by an annular rim 18. The trash container is further illustrated in a horizontal position relative to the ground 19.

Attached to the open end 16 and more particularly to the rim 18 of the trash container is a novel and useful dustpan, indicated generally at 20. As indicated in FIG. 1, the dustpan is being employed as a filling aid or guide for trash container 10. That is, any trash or refuse, such as leaves, lawn cuttings, etc., that is disposed on the surface of ground 19 can be readily placed in the container 10 by first sweeping the refuse over the dustpan 20 and then into the container.

Thus, it is important to note that the dustpan 20 may be used in the conventional manner as a hand-held device or as a filling-aid attachment for various types of refuse containers. Dustpan 20 is formed with a main body, generally indicated at 22, defining a scoop 23 having a substantially flat inclined ramp member 24, the leading transverse edge thereof being formed with a downwardly inclined lip member 26 defining the front of the dustpan.

Integrally formed rearwardly of ramp 24 is a centrally positioned extension member that is designed to provide a handle, designated at 28. This handle or extension further defines a portion of an attaching means which will hereinafter be described in more detail.

Scoop 23 further includes converging guide members 30 and a plurality of converging rib members 32 which all contribute in guiding the debris or trash that is swept over ramp member 24 directly into the mouth of opening 16. When using the dustpan in the conventional manner wherein handle 28 is freely held in one's hand, debris is substantially entrapped within the scoop area by means of the guide members 30 and ribs 32. To further define the scoop area, wedge-shaped depending flange members 34 are formed along the opposite longitudinal sides extending from the front of the main body to the rear thereof, the rear end portion of each flange member 34 being extended outwardly so as to form extended leg members 36.

Accordingly, the downwardly projecting flange members 34 also define stabilizing means when dustpan 10 is attached to container 10, as seen in FIG. 1.

Figure 2:
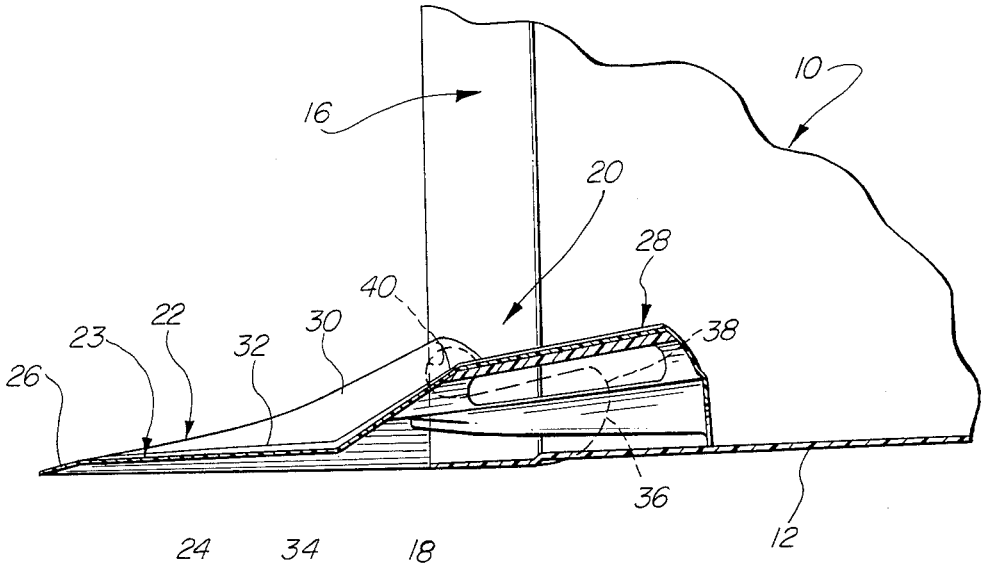
FIG. 2 is an enlarged cross-sectional view taken substantially along line 2—2 of FIG. 1.
Figure 3:
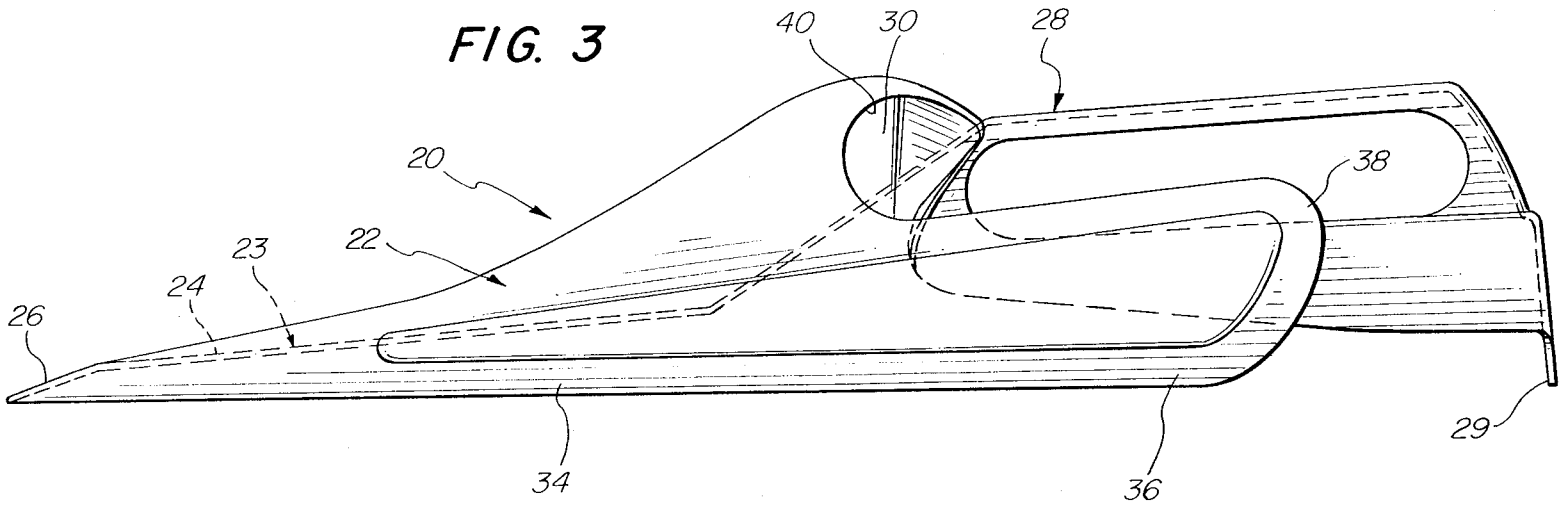
FIG. 3 is a side-elevational view of the dustpan without being attached to a refuse container.
Figure 4:
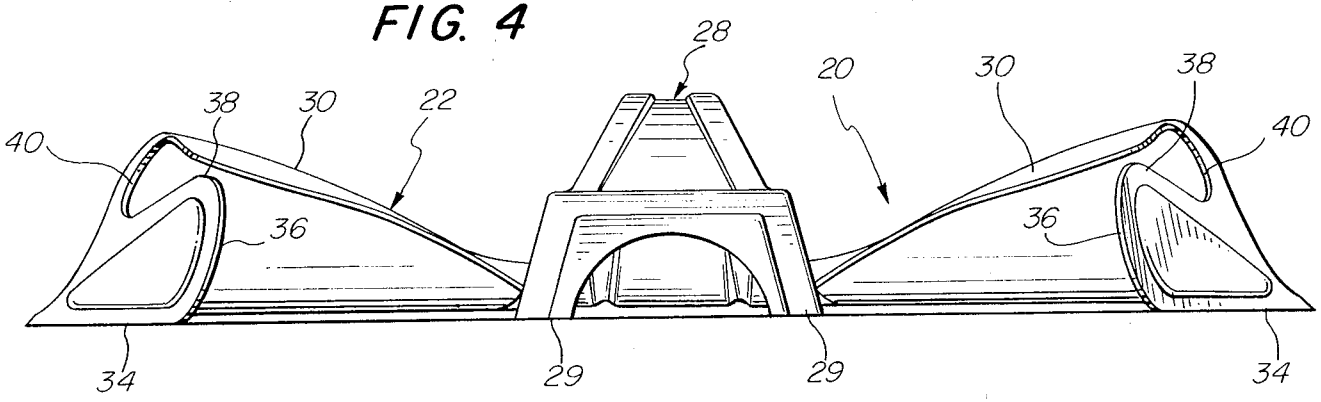
FIG. 4 is a rear-elevational view thereof.

When attaching dustpan 20 to rim 18 of the container, handle 28 is inserted into opening 16 over the inside surface of wall 12, at which time leg members 36 are positioned adjacent the outer surface of wall 12, as shown in FIGS. 1 and 2. Moreover, in order to provide the attaching means (leg members 36 and handle 28) with a firm grip on rim 18, the handle 28 is formed with a pair of depending tooth-like members 29 which are located at the distal end of handle 28 so as to establish a gripping force between handle 28 and the spaced-apart leg members 36, whereby the leg members themselves are formed with enlarged lobe ends 38.

After the rim of container 10 is positioned between handle 28 and leg members 36, dustpan 20 is further forced inwardly until rim 18 is received in notches 40 which are each formed in the upper intermediate portion of side flanges 34.

It should be noted that dustpan 20 is preferably made from a semi-rigid plastic material whereby leg members 36 have a natural gripping action against wall 12. Accordingly, once positioned on the container, the dustpan 20 must be forcedly removed therefrom after use.

Referring again to FIG. 1, it can be seen that dustpan 20 is firmly attached to the annular rim 18 of container 10. The dustpan and the container are shown in the suggested mode wherein the container lies horizontally on its side and the dustpan rests flatly on the ground surface 19. Thus, with the incorporation of the stabilizing means provided by side flanges 34, container 10 is held in a fixed position and is prevented from rolling from side to side while one sweeps debris into the container. Such an arrangement of the present invention allows for large amounts of debris to be cleaned up in a shorter period of time and in a more simple manner.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A combination dustpan and guide for filling trash containers, comprising:

a main body member having a scoop portion formed therein;

stabilizing means formed as part of said main body whereby said dustpan, when attached to a trash container, prevents said trash container from rolling when placed in a horizontal position;

said stabilizing means comprising a pair of depending flange members formed longitudinally along each side of said dustpan;

said flange members extending rearwardly of said scoop portion, forming a pair of oppositely disposed leg members so as to be positioned under said trash container when said trash container is laid in a horizontal position;

attaching means formed rearwardly of said scoop portion, whereby said dustpan is removably attached to said trash container;

said attaching means including a handle and said leg members, said handle is inserted into said trash container;

at least one depending tooth-like member extending downwardly from said handle for gripping engagement with the inner surface of said container wall;

each of said leg members being formed with an enlarged rear lobe portion, said lobe portions engage the outer surface of said container wall said trash container being gripped between said tooth-like member and said lobe portions; and guide means formed in said scoop portion to guide and direct debris directly into said container when said debris is swept into and over said dustpan.

2. A combination of the invention as recited in claim 1, wherein said attaching means includes a pair of notches, each of said notches being formed in the upper intermediate portion of said depending flange member, whereby the annular rim of said container is received therein.

3. A combination of the invention as recited in claim 2, wherein said scoop portion of said main body member is formed with a transverse lip member.

4. A dustpan comprising:

a main body member formed with a substantially flat, inclined ramp member arranged to receive debris thereon and a handle extending therefrom;

means for attaching said dustpan to the annular rim of a conventional-type trash container;

wherein said attaching means comprises:

at least one depending tooth-like member formed on the rear portion of said handle for engagement with said inner surface of said trash container; and a pair of oppositely disposed leg members projecting rearwardly from said main body and adapted for engagement with the outer surface of said trash container;

guide means formed in said main body member, whereby debris is directed into said trash can when said dustpan is attached thereto;

said handle rearwardly and centrally positioned relative to said main body for locking engagement with the annular rim of said trash container;

means formed on said dustpan for retaining said trash container in a stabilized mode when said trash container is laid in a horizontal position, whereby debris is swept over said dustpan and into said trash container;

wherein said means for retaining said trash container in a stabilized position comprises:

a pair of oppositely positioned, depending flange members integrally formed along the longitudinal edges of said main body member;

said flange members extending rearwardly, defining said leg members of said attaching means;

wherein said attaching means includes:

an enlarged lobe formed in each of said leg members for direct engagement with said outer surface of said trash container; and a notch formed in the upper midsection of each of said depending flange members, whereby said annular rim of said trash container is received therein.

5. A dustpan as recited in claim 4, wherein said guide means comprises a pair of guide members formed at the rearward portion of said ramp, said guide members being slanted inwardly and upwardly of said ramp and said depending flanges.

* * * * *